US011118855B2

(12) United States Patent
Koester

(10) Patent No.: US 11,118,855 B2
(45) Date of Patent: Sep. 14, 2021

(54) EXTRACTOR FOR REVOLVERS

(71) Applicant: George Koester, Berlin (DE)

(72) Inventor: George Koester, Berlin (DE)

( * ) Notice: Subject to any disclaimer, the term of this patent is extended or adjusted under 35 U.S.C. 154(b) by 0 days.

(21) Appl. No.: 16/753,957

(22) PCT Filed: Oct. 5, 2018

(86) PCT No.: PCT/EP2018/077168
§ 371 (c)(1),
(2) Date: Apr. 6, 2020

(87) PCT Pub. No.: WO2019/068886
PCT Pub. Date: Apr. 11, 2019

(65) Prior Publication Data

US 2020/0355451 A1 Nov. 12, 2020

(30) Foreign Application Priority Data

Oct. 6, 2017 (DE) ..... 10 2017 123 245.1

(51) Int. Cl.
*F41A 15/02* (2006.01)

(52) U.S. Cl.
CPC ..... *F41A 15/02* (2013.01)

(58) Field of Classification Search
CPC ..... F41A 15/02
USPC ..... 42/68
See application file for complete search history.

(56) References Cited

U.S. PATENT DOCUMENTS 4,015,356 A * 4/1977 Maillard ..... F41A 15/02 42/68
4,127,955 A * 12/1978 Curran ..... F41A 15/02 42/68
4,541,193 A 9/1985 Flippin
4,543,741 A 10/1985 Phillips
4,934,082 A * 6/1990 Laendler ..... F41A 15/02 42/68
5,218,148 A * 6/1993 Mochak ..... F41A 15/02 42/68
5,341,587 A 8/1994 Phillips
7,263,795 B1 * 9/2007 Curry ..... F41A 15/02 42/64

(Continued)

FOREIGN PATENT DOCUMENTS

EP 0143116 A1 6/1985

OTHER PUBLICATIONS

International Search Report dated Dec. 12, 2018, in connection with International PCT Application No. PCT/EP2018/077168.

(Continued)

*Primary Examiner* — Bret Hayes
(74) *Attorney, Agent, or Firm* — Norris McLaughlin, P.A.

(57) ABSTRACT

The invention relates to an extractor for a revolver with a drum for extracting cartridges from cartridge chambers arranged in the drum wherein the extractor rod of the extractor is arranged in the axis of rotation of the drum and the extractor rod loaded by a spring cooperates with a multi-armed extractor star connected to the extractor rod, wherein the extractor star extends in the radial direction relative to the orientation of the extractor rod and the extractor star arms of the extractor star have end portions which correspond to a casing of the cartridge or a circumferential cartridge groove running around the casing of the cartridge.

11 Claims, 5 Drawing Sheets

(56) References Cited

U.S. PATENT DOCUMENTS

2014/0059912 A1 3/2014 Ecker

OTHER PUBLICATIONS

Figure 1:
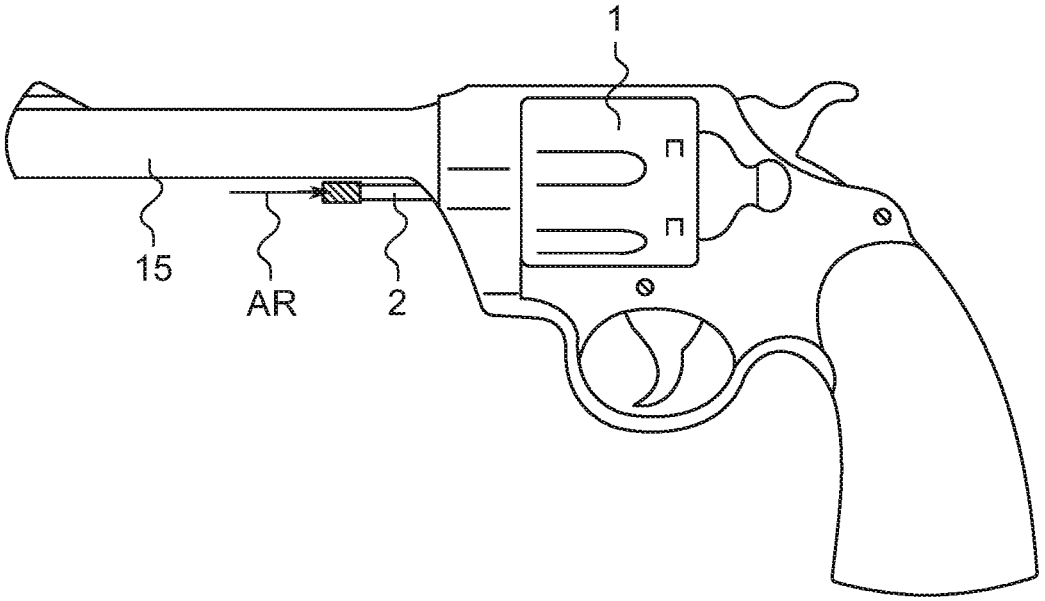

English Translation of International Search Report dated Dec. 12, 2018, in connection with International PCT Application No. PCT/EP2018/077168.
Written Opinion in connection with International PCT Application No. PCT/EP2018/077168.

* cited by examiner

EXTRACTOR FOR REVOLVERS

This application is the U.S. National Stage of International Application No. PCT/EP2018/077168, filed Oct. 5, 2018, which claims foreign priority benefit under 35 U.S.C. § 119 of German Application No. 10 2017 123 245.1, filed Oct. 6, 2017.

The invention relates to an extractor for a revolver. The extractor serves to transport the cartridges or cartridge cases out of the drum of a revolver.

Revolvers are firearms in which the cartridges are arranged in individual cartridge chambers in a cartridge chamber designed as a rotating drum. The drum also serves as a magazine.

By rotating the drum, the cartridges can be brought into alignment with the course of the revolver one after the other.

Extractors for revolvers are known in different designs.

For example, a revolver with an extractor is known from publication U.S. Pat. No. 4,543,741 A. An extractor mechanism for the revolver with a conventional drum comprises an axle that can be moved in the longitudinal direction of the drum. The axle is connected to outwardly directed housing contact arms, whereby the housing contact arms are made of a slightly springy material. The extended ends of the housing contact arms are shaped so that they protrude into a circumferential groove in the cartridge case. This allows the cartridge or cartridge to be held in the ignition position. The extractor can also be actuated in the usual way to transport the cases out of the drum.

Another ejector with a positioning mechanism is known from the publication U.S. Pat. No. 5,341,587, which is intended in particular to enable the use of cartridges of different lengths. It is intended that an ejector rod extending in the longitudinal direction can be moved along its longitudinal axis relative to a central through hole of the drum. The ejector star is connected to a spring mechanism oriented parallel to the ejector rod.

The invention is based on the task of providing an extractor for a revolver which does not weaken the drum in the area of the passage of an extractor rod. The extractor should also allow the cartridges to be positioned. It should be possible to use cartridges with a rim as well as rimless cartridges of different lengths.

The invention relates to an extractor for a revolver for extracting cartridges from the cartridge chambers of the revolver located in the drum.

The extractor according to the invention is located in the drum. It is used to transport the cartridge cases remaining in the cartridge chambers after firing the ammunition. By moving the extractor rod with the help of the attached extractor star, all cartridge cases or cartridges are ejected simultaneously. The extractors are also called ejectors.

The starting point of the invention is an extractor for a revolver for extracting cartridges from cartridge chambers arranged in the drum of the revolver. The extractor is formed by an extractor rod arranged in the hub of the drum and loaded with a spring and a multi-armed extractor star attached to it. The extractor star with its extractor star arms extends in radial direction relative to the orientation of the extractor rod. Furthermore, the extractor star arms have end sections which correspond to the casing of the cartridge.

In accordance with the invention, it is provided that the extractor star is formed as a flat plate and the extractor star arms of the extractor star each have an extractor star arm spring acting in a radial direction, which, through the end portions of the extractor star arms of the extractor star, causes a movement of the extractor star arms in a radial direction towards the extractor rod.

Due to the spring-loaded extractor star arms designed in this way, they can adapt to the relevant diameter of the respective cartridge in an advantageous way. This means that the end sections of the extractor star arms can be pressed up to the casing of the cartridge in the case of rimmed cartridges or into the circumferential cartridge groove of rimless cartridges. This is an advantageous way of achieving positive contact between the extractor star arms and the cartridges. Thus, it is possible that the movement of the extractor in the direction of extraction causes the cartridges to be transported out of the cartridge chambers arranged in the drum.

This allows a flexible adaptation of all extractor star arms to the respective design of the cartridge used in an advantageous way.

Thus, the extractor star can be used in an advantageous way for different types of cartridges at the same time, as each extractor star arm adapts to the respective cartridge.

Due to the flat design of the extractor star and the radially acting springs integrated in the extractor star arms, it is advantageous not to have to provide corresponding recesses in the hub of the drum. The hub of the drum is therefore advantageously not weakened, and less material has to be removed from the drum.

Further preferred embodiments of the invention result from the other features mentioned in the dependent claims.

According to an advantageous design of the invention, the extractor star is made of spring steel.

The spring, in the following called extractor star arm spring, is realized by cut-outs in the extractor star arms. The milled recesses are oriented transversely to the radial direction as well as transversely to the orientation of the extractor rod.

This leaves a meandering or Z-shaped section of the extractor star between the milled areas, which realizes the spring effect in an advantageous way.

The extractor star is accordingly easy to manufacture. No separate springs with guidance have to be mounted. The space requirement is low and the reliability of the spring-loaded extractor star arms is high.

In the preferred embodiment of the invention, the extractor star arm spring is designed in such a way that the spring travel distance of the extractor star arm spring corresponds to the depth of a cartridge groove encircling a rimless cartridge. This allows the end sections of the extractor star arms to adapt to the two relevant cartridge diameters in an advantageous manner by means of the spring travel distance.

According to a preferred design of the invention, the extractor rod is connected to a locking plate extending in radial direction, wherein the extractor star is displaceably arranged on the extractor rod, while the locking plate is arranged in front of the extractor star in the direction of extraction.

The locking plate is further provided with pins, each pin being assigned to an extractor star arm and the pins being oriented in the direction of extraction.

The pins are arranged in such a way that one pin per extractor star arm interacts with at least one, preferably two, positioning holes located in the extractor star arm between the extractor star arm spring and the end sections of the extractor star arms.

The positioning holes are also oriented in the same direction. The distance between the positioning holes of an extractor star arm arranged in radial direction to each other corresponds to the depth of the surrounding cartridge groove.

By moving the extractor rod connected to the locking plate, the pins of the locking plate are pushed into the positioning holes in the extractor star arranged on the extractor rod so that they can be moved along the path.

The preferably two positioning holes allow the respective extractor star arm to be locked in two positions in an advantageous manner—a first position in which the end sections of the respective extractor star arm lie against the casing of a rimmed cartridge and a second position in which the end sections of the extractor star arm protrude into the cartridge groove of a rimless cartridge.

This allows the spring-loaded extractor star arms to be fixed in such an advantageous way that they can be locked in a first position against the cartridge shell or in a second position in the surrounding cartridge groove.

The spring deflection is limited by the locking device and the position of the end sections is thus adapted to the relevant cartridge diameter of the casing or the internal diameter of the cartridge groove. The spring realizes the adjustment to the relevant diameter and the pins with the positioning holes ensure the fixation of the respective extractor star arm when the extractor star is moved to extract the cartridge.

This is an advantageous way of preventing the extractor star arms from retracting during extraction due to the rounded groove of rimless cartridges, which would cause the cartridge to remain in the drum. It also prevents the cartridges from jamming when being pulled out of the cartridge chambers.

According to an advantageous design of the invention, a ratchet is connected to the extractor rod in the direction of extraction after the extractor star. The ratchet, as a known component of a revolver, causes the drum to rotate after the trigger is actuated in such a way that the next cartridge is aligned with the barrel after one cartridge has been fired.

According to another preferred design of the invention, the end sections of the extractor star arms are provided with a chamfer or a contour corresponding to the cartridge groove.

The chamfering of the end sections of the extractor star arms facilitates the insertion of the cartridges. The contour of the end sections preferably corresponds to the shape of the cartridge groove of a rimless cartridge, so that the form closure is improved and thus a safe extraction of the cartridges is possible, even with a small cartridge groove depth.

Figure 2:
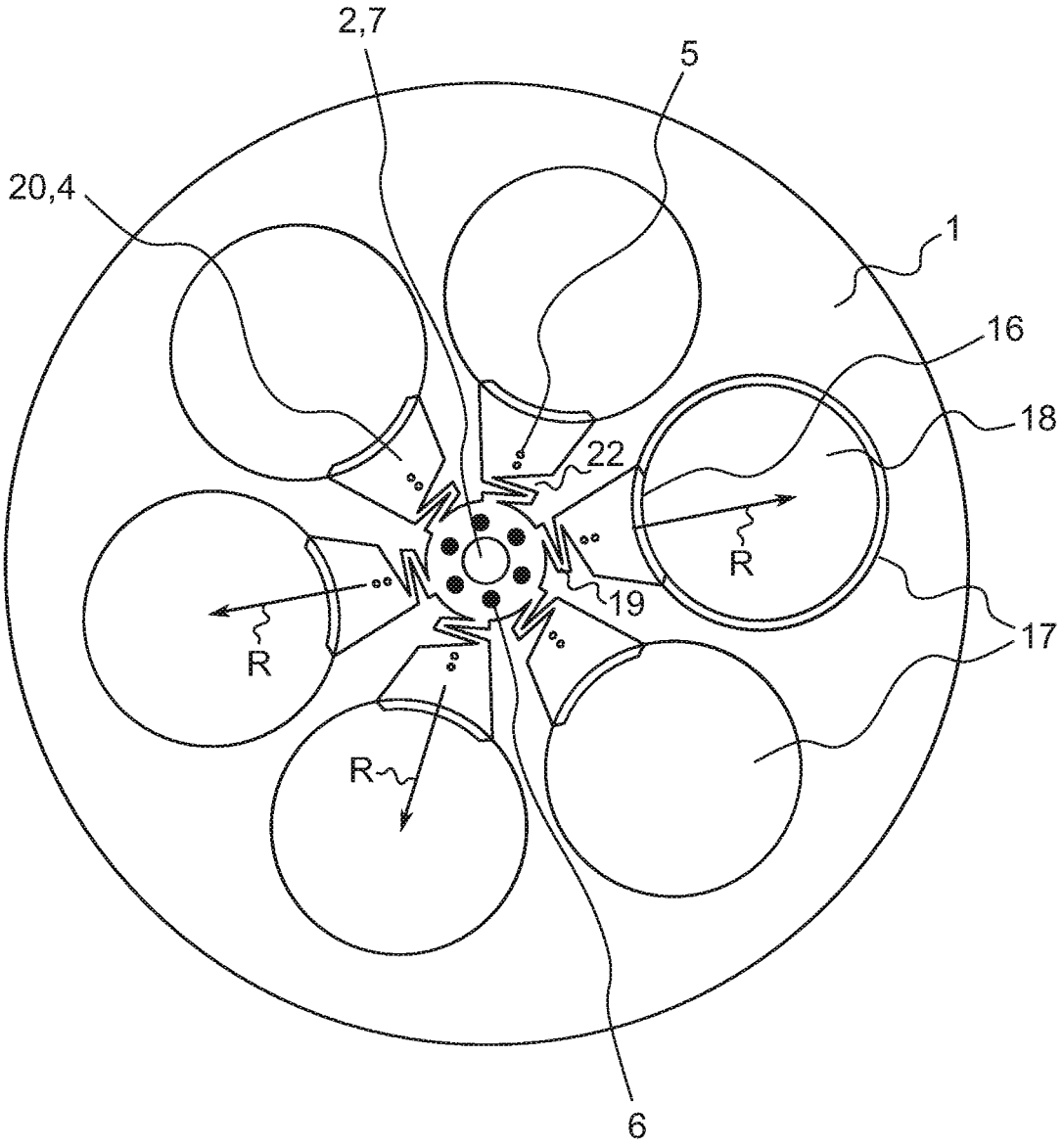
Figure 3:
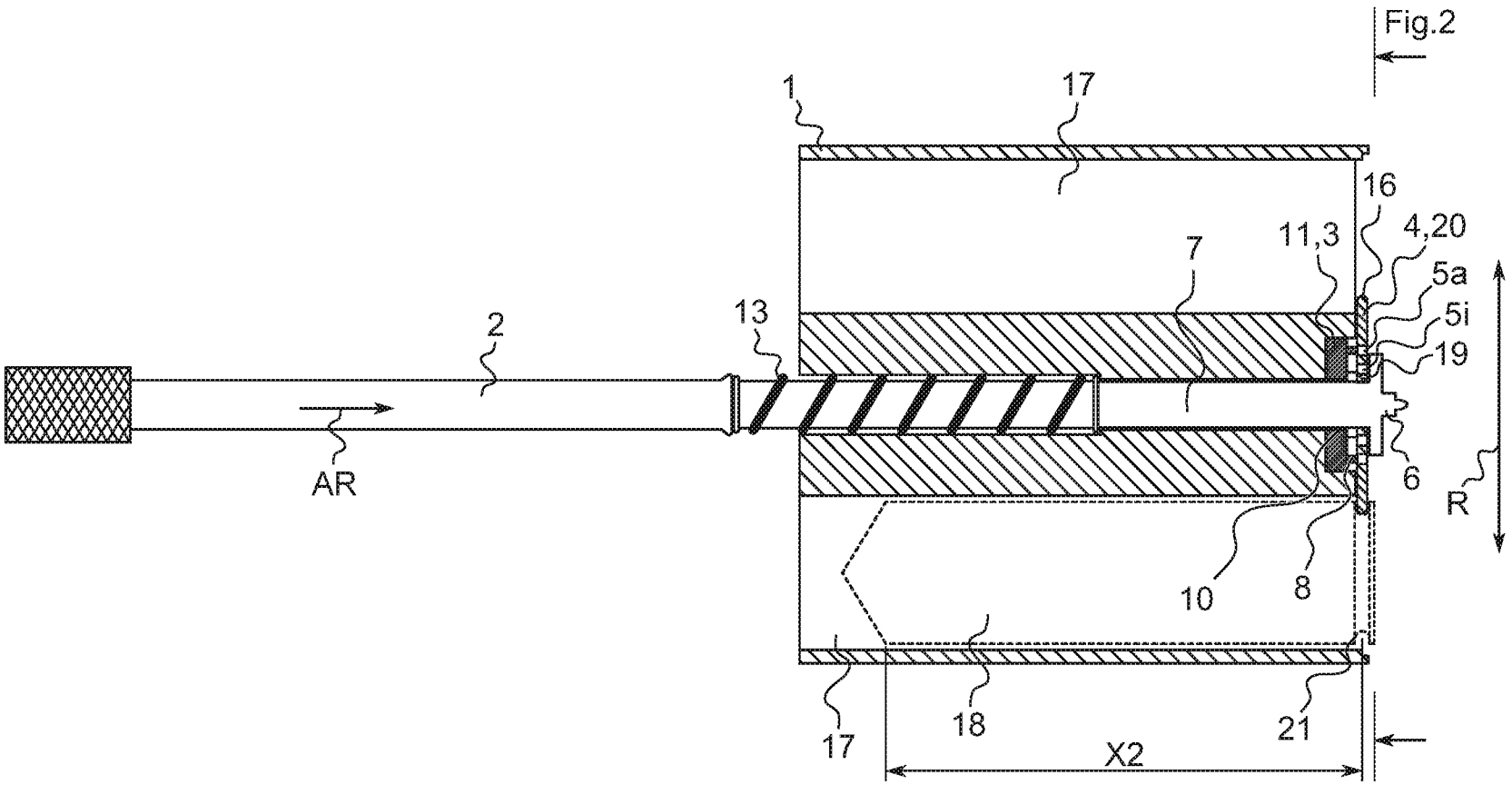
Figure 4:
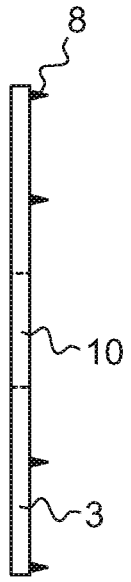
Figure 5:
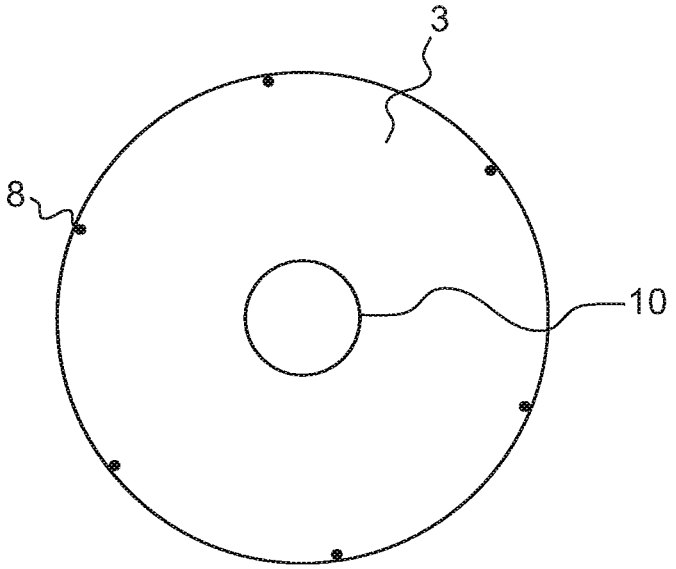
Figure 7:
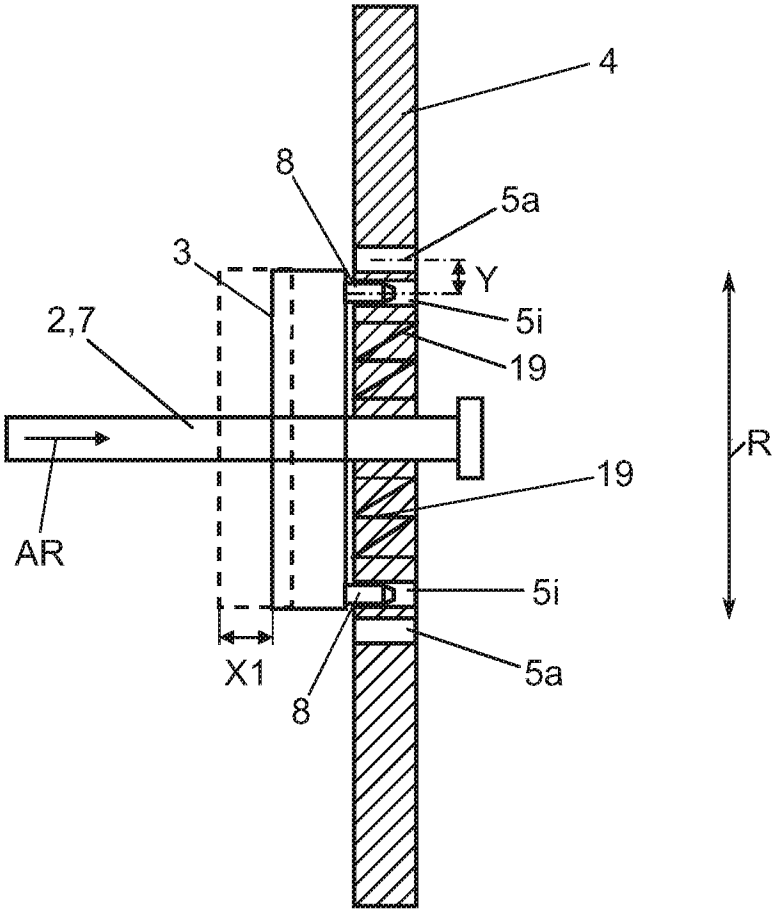
Figure 6:
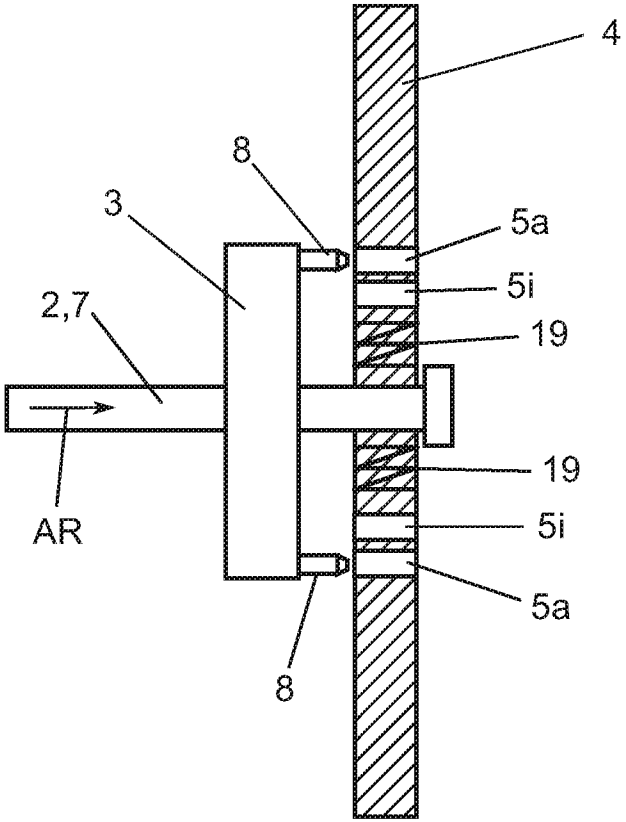

The invention is explained in the following in exemplary embodiments based on the corresponding drawings. They show:

FIG. 1 a revolver in side-view,

FIG. 2 a view of the drum with extractor star from the rear,

FIG. 3 a longitudinal section through the drum,

FIG. 4 a locking plate in side-view,

FIG. 5 a locking plate from the back,

FIG. 6 a longitudinal sectional view of the extractor star with locking plates in the rest position and FIG. 7 a longitudinal sectional view of the extractor star with locking plates in the second locking position.

FIG. 1 shows a known revolver in side-view. The revolver comprises a rotating drum 1 with cartridge chambers (not shown) in which the cartridges (not shown) are arranged. The cartridges can be aligned with barrel 15 by rotating drum 1. By actuating the extractor rod 2, 7 in extraction direction AR, the cartridges, i.e. preferably the cartridge cases remaining after firing, can be conveyed out of the cartridge chamber of drum 1.

The extractor rod 2 or the axle rod 7 (compare FIGS. 2, 3, 6, 7) of the extractor rod 2 also forms the axis of rotation for drum 1.

FIG. 2 shows a view of drum 1 with the extractor star 4 from the rear. The view is accordingly oriented against the direction of extraction in the firing direction.

The extractor rod 2 or the axle rod 7 (compare FIGS. 3, 6, 7) of the extractor rod 2 is connected to the six-armed flat plate-shaped extractor star 4 so that it can be moved over a pre-determined length (compare FIG. 7) via a first path X1.

The extractor star arms 20 of the extractor star 4 are spring-loaded in radial direction (R) in relation to the extractor rod 2, 7.

The extractor star arms 20 protrude with their end sections 16 into the cartridge chambers 17, which are arranged in drum 1 and in which the cartridges 18 are placed.

For the realization of the suspension, the extractor star arms 20 are provided with milled recesses 22, so that the extractor star arms in this area are meander-shaped or Z-shaped. In this way, according to the invention, the extractor star arm springs 19 are advantageously integrated into the extractor star arms 20 (compare FIG. 2). Thus, the extractor star 4 can be easily manufactured from a corresponding spring steel plate.

The end sections 16 of the extractor star arms 20 are pressed by the extractor star arm springs 19 accordingly to the casing of the rimmed cartridges 18 or, in the case of rimless cartridges 18, pushed into a cartridge groove 21 (compare FIGS. 3, 6, 7).

This ensures positive contact between the end sections 16 of the extractor star arms 20 and the cartridges 18, thus enabling the cartridges 18 to be ejected in the extraction direction AR via the second path X2, the so-called extraction path (compare FIG. 3).

Two positioning holes 5, arranged in radial direction R to each other, are provided in the extractor star arms 20 of the extractor star 4.

The positioning holes 5 are used to accommodate the pins 8 shown in FIGS. 3 to 7, which are fixed in the locking plate 3 and oriented in the AR extraction direction.

By means of the two positioning holes 5, arranged in radial direction R, the extractor star arms 20 can be locked in two different locking positions depending on the type of cartridges 18. A first locking position corresponds to the use of rimmed cartridges 18, whereby the end sections 16 of the extractor star arms 20 each rest against the casing of the cartridges 18. The second locking position is relevant when using rimless cartridges 18 with circumferential cartridge groove 21. Here the end sections 16 of the extractor star arms 20 protrude into the circumferential cartridge groove 21 (compare also FIGS. 6 and 7).

A ratchet device 6 is also arranged on the extractor star 4. The ratchet device 6 as a separate part is only shown in a schematic diagram. The ratchet device 6 is used to rotate the drum 1, whereby the rotation is triggered by the trigger each time a cartridge 18 is fired, so that the next cartridge 18 is aligned with barrel 15 (see FIG. 1).

FIG. 3 shows a longitudinal sectional view through the drum 1 of the revolver with the locking plate 3 attached to the extractor rod 2 and the extractor star 4 slidably attached to the extractor rod 2. FIGS. 6 and 7 show details from FIG. 3, which illustrate the interaction of the locking plate 3 with the pins 8 attached to it and the extractor star 4 with the two positioning holes 5*i*, 5*a* arranged in the extractor star arms 20 in the extraction direction AR.

FIG. 3 shows the locking plate 3, which is connected to the extractor rod 2 by means of thread 10, or to an axle rod 7 screwed to the extractor rod 2.

When not in use, the locking plate 3 is positioned in a small recess 11 in the hub area of drum 1.

On the locking plate 3 there are pins 8 oriented in the direction of AR in the direction of the extractor star arms 20.

The extractor rod 2 is guided by the six-armed extractor star 4 on the first path X1, which is slightly longer than the length of the pins 8, so that it can be moved in the extraction direction AR.

Corresponding to the cartridges 18 placed in the cartridge chambers 17 of drum 1, the end sections 16 of the extractor star arms 20 are pressed against the casing or into the cartridge groove 21 of the respective cartridge 18 by the extractor star arm springs 19, which are only symbolically represented here.

Thus, the respective extractor star arms 20 adapt to the respectively assigned cartridge 18.

The illustrations in FIGS. 3 and 6 show the resting state. The locking plate 3 with the pins 8 attached to it lies opposite the extractor star arms 20 with the positioning holes 5*i*, 5*a*.

Specifically, the respective pin 8 is arranged opposite the respective outer positioning hole 5*a*. The extractor star arm springs 19 are compressed in FIG. 6. Thus, the end sections 16 of the extractor star arms 20 are in contact with the casing of the cartridge 18 or in the cartridge groove 21 (compare FIG. 3).

A spring travel distance Y of the extractor star arm springs 19 in radial direction (R) (compare FIG. 7) to the extension direction AR corresponds to the distance between the two positioning holes 5*i*, 5*a*.

By actuating the extractor rod 2, 7 in extraction direction AR by the first distance X1, the locking plate 3 is pushed against the extractor star 4, whereby the pins 8 of the locking plate 3 are pressed into one of the two positioning holes 5*i*, 5*a* of the extractor star arm 20 each and thus locked.

FIG. 7 shows the locked position of the extractor star arms 20. Here the end sections 16 of the extractor star arms 20 protrude into the circumferential cartridge groove 21 of a rimless cartridge 18 (compare FIG. 3).

The extractor star arms 20 are thus locked in this position. The locking is achieved by pushing the extractor rod 2, 7 with the locking plate 3 against the extractor star 4 by the first distance X1, so that the pins 8 protrude into one of the positioning holes 5*a*, 5*i*-here into the positioning hole 5*i*. The locking device thus cancels the effect of the extractor star arm springs 19.

When the pins 8 protrude into the outer positioning holes 5*i*, the extractor star arms 20 are locked in the position adjacent to the casing of the rimmed cartridges 2.

The inner positioning holes 5*i* are used to lock the extractor star arms 20 in the groove of the rimless cartridges 2, in other words, when the pins 8 protrude into the inner positioning holes 5*i*, the extractor star arms 20 are locked in the groove of the rimless cartridges 2.

Thus, by means of the spring travel distance Y of the extractor star arm springs 19 in radial direction (R) (compare FIG. 7) to the extraction direction AR, two lockable positions of the pins 8 are ensured in an advantageous way.

In other words, the two positioning holes 5*a*, 5*i* allow the respective extractor star arm 20 to be locked in two positions, a first position in which the end sections 16 of the respective extractor star arm 20 lie against the casing of a rimmed cartridge and a second position in which the end sections 16 of the respective extractor star arm 20 project into the cartridge groove 21 of a rimless cartridge.

Subsequently, by continuing the movement around the second path X2 of the extractor rod 2, 7 in the extraction direction AR, cartridge 18 is pushed out of cartridge chamber 17 (compare FIG. 3).

After the cartridge 18 has been ejected, the extractor rod 2 with the locking plate 3 is retracted to the rest position (compare FIGS. 3 and 6) by the compression spring 13 with counter bearing in the drum 1, which is located on the extractor rod 2.

Preferably the end sections 16 of the extractor star arms 20 are chamfered to allow easy insertion of the cartridges 18 into the cartridge chamber 17. Preferably the end sections 16 have a contour that corresponds to the circumferential cartridge groove 21.

FIG. 4 shows a locking plate 3 as a single part in side-view.

The locking plate 3 is disc-shaped. The pins 8 are arranged vertically on the outer edge of the locking plate 3, whereby each extractor star arm 20 is assigned a pin 8. The pins 8 are chamfered, in particular tapering, so that they can be easily pushed into the positioning holes (not shown) in the extractor star (not shown).

In the middle there is a hole with internal thread 10 for fixing the locking plate 3 to the extractor rod (not shown).

FIG. 5 shows a locking plate 3 in a single part view opposite to the pull-out direction with the pins 8 arranged at the edge.

In the middle there is a hole with internal thread 10 for fixing the locking plate 3 to the extractor rod 2 (not shown).

LIST OF REFERENCE SIGNS

1*d* rum
2 extractor rod
3 locking plate
4 extractor, extractor star
5*i* internal positioning hole
5*a* outer positioning hole
6 ratchet device
7 axis rod of the extractor rod
8 locking plate pin, pin
10 internal thread in the locking plate
11 Recess for the locking plate,
13 spring, compression spring
15 barrel
16 end sections of the extractor star arms
17 cartridge chamber in the drum
18 cartridge, cartridge case
19 spring of the extractor star arm, extractor star arm spring
20 extractor star arm
21 cartridge groove, groove
22 milled recesses
AR extraction direction
R radial direction
X1 first path for locking
X2 second path for extraction
Y travel distance of the extractor star arm spring

The invention claimed is:

1. An extractor for a revolver comprising:

a drum configured for extracting cartridges from cartridge chambers arranged in the drum; and an extractor rod arranged in an axis of rotation of the drum and loaded by a spring that cooperates with an extractor star connected to the extractor rod, wherein the extractor star extends in a radial direction relative to an orientation of the extractor rod, extractor star arms of the extractor star have end portions that correspond with a casing of the extracting cartridges or a circumferential cartridge groove on the casing of the extracting cartridges, the extractor star is constructed as a flat plate, each extractor star arm of the extractor star has an extractor star arm spring acting in the radial direction, which through the end portions of the extractor star arms cause a movement of the extractor star arms in the radial direction relative to the extractor rod, the extractor rod is connected to a locking plate extending in the radial direction, and the extractor star is arranged displaceably on the extractor rod while the locking plate is arranged in front of the extractor star in a direction of extraction.

2. The extractor according to claim 1, wherein the extractor star consists of spring steel and each extractor star arm spring is realized by at least one milled recess provided in each extractor star arm both transversely to the radial direction and transversely to the orientation of the extractor rod such that the extractor star arm spring is are configured to be in a meandering shape or a Z-shape.

3. The extractor according to claim 1, wherein a spring travel distance of the extractor star arm spring corresponds to a depth of a circumferential cartridge groove surrounding a rimless cartridge.

4. The extractor according to claim 1, wherein the locking plate is provided with pins associated with the respective extractor star arms, the are arranged oriented in the direction of extraction.

5. The extractor according to claim 4, wherein the locking plate is arranged such that one pin is provided for each extractor star arm, that cooperates in each case with two positioning holes arranged in the extractor star arm between the extractor star arm spring and the end portions of the extractor star arm, and positioning holes corresponding to the pins are oriented in the extraction direction.

6. The extractor according to claim 5, wherein a distance between the positioning holes corresponds to a depth of the circumferential cartridge groove made in the casing of the extraction cartridges in the radial direction to the extraction direction, and a spring travel distance of the extractor star arm spring in the radial direction to the extraction direction corresponds to the distance between the two positioning holes.

7. The extractor according to claim 1, wherein pins of the locking plating, engaged in the positioning holes, lock the extractor star arm in two positions comprising:

a first position such that the end portions of the extractor star arm rest against a casing of a rimmed cartridge; and a second position such that the end portions of the extractor star arm project into the circumferential cartridge groove of a rimless cartridge.

8. The extractor according to claim 1, wherein the end portions of the extractor star arms are provided with a chamfer or a contour corresponding to the circumferential cartridge groove of the extracting cartridges.

9. The extractor according to claim 1, further comprising:

a ratchet, connected to the extractor rod, is arranged after the extractor star in an extraction direction.

10. An extractor for a revolver comprising:

a drum configured for extracting cartridges from cartridge chambers arranged in the drum; and an extractor rod arranged in an axis of rotation of the drum and loaded by a spring that cooperates with an extractor star connected to the extractor rod, wherein the extractor star extends in a radial direction relative to an orientation of the extractor rod, extractor star arms of the extractor star have end portions that correspond with a casing of the extracting cartridges or a circumferential cartridge groove on the casing of the extracting cartridges, the extractor star is constructed as a flat plate, each extractor star arm of the extractor star has an extractor star arm spring acting in the radial direction such that the end portions of the extractor star arms cause a movement of the extractor star arms in the radial direction relative to the extractor rod, the extractor star consists of spring steel, and each extractor star arm spring is realized by at least one milled recess provided in each extractor star arm both transversely to the radial direction and transversely to the orientation of the extractor rod such that the extractor star arm spring is configured to be in a meandering shape or a Z-shape.

11. An extractor for a revolver comprising:

a drum configured for extracting cartridges from cartridge chambers arranged in the drum; and an extractor rod arranged in an axis of rotation of the drum and loaded by a spring that cooperates with an extractor star connected to the extractor rod, wherein the extractor star extends in a radial direction relative to an orientation of the extractor rod, extractor star arms of the extractor star have end portions that correspond with a casing of the extracting cartridges or a circumferential cartridge groove on the casing of the extracting cartridges, each extractor star arm of the extractor star has an extractor star arm spring acting in the radial direction such that the end portions of the extractor star arms cause a movement of the extractor star arms in the radial direction relative to the extractor rod, and pins of the locking plating, engaged in positioning holes, lock the extractor star arm in two positions comprising:

a first position such that the end portions of the extractor star arm rest against a casing of a rimmed cartridge; and a second position such that the end portions of the extractor star arm project into the circumferential cartridge groove of a rimless cartridge.

* * * * *